US007861762B2

(12) United States Patent
Meichtry

(10) Patent No.: US 7,861,762 B2
(45) Date of Patent: Jan. 4, 2011

(54) OVERHEAD DOORS AND ASSOCIATED TRACK, GUIDE, AND BRACKET ASSEMBLIES FOR USE WITH SAME

(75) Inventor: Michael M. Meichtry, Brookfield, WI (US)

(73) Assignee: 4Front Engineered Solutions, Inc., Carrollton, TX (US)

( * ) Notice: Subject to any disclaimer, the term of this patent is extended or adjusted under 35 U.S.C. 154(b) by 310 days.

(21) Appl. No.: 12/191,146

(22) Filed: Aug. 13, 2008

(65) Prior Publication Data

US 2009/0044917 A1 Feb. 19, 2009

Related U.S. Application Data

(60) Provisional application No. 60/956,368, filed on Aug. 16, 2007.

(51) Int. Cl.
*E05D 15/00* (2006.01)

(52) U.S. Cl. ..... 160/210; 160/205

(58) Field of Classification Search ..... 160/181, 160/201, 205, 273.1, 274, 276, 264, 280, 160/281, 282, 285, 288
See application file for complete search history.

(56) References Cited

U.S. PATENT DOCUMENTS 1,787,451 A 1/1931 Mohun et al.
1,990,870 A * 2/1935 Kelly ..... 160/194
2,064,470 A 12/1936 Heckman
2,090,146 A 8/1937 Pixley
2,124,969 A 7/1938 Bagley et al.
2,686,926 A 8/1954 Schacht, Jr. et al.
2,839,135 A 6/1958 Anderson
3,140,508 A 7/1964 Switzgable
3,188,698 A 6/1965 Zoll et al.
3,336,968 A 8/1967 Curtis (Continued)

FOREIGN PATENT DOCUMENTS

WO WO-2008/045037 4/2008

OTHER PUBLICATIONS

"MpactDoor," Aaron-Bradley Company, 1 page [date unknown].

(Continued)

*Primary Examiner*—Katherine W Mitchell
*Assistant Examiner*—Jaime F Cardenas-Garcia
(74) *Attorney, Agent, or Firm*—Perkins Coie LLP

(57) ABSTRACT

Overhead door guide assemblies, guide tracks, and guide track support brackets are disclosed herein. An overhead door track assembly configured in accordance with one embodiment of the invention includes a vertical track segment mounted to a wall adjacent an opening therein, and a curved track segment operably coupled to the vertical track segment. The curved track segment includes a first guide surface spaced apart from a second guide surface to define a first gap region that movably receives the door guide members as the door moves away from the opening. The track assembly further includes a non-vertical track segment operably coupled to the curved track segment. The non-vertical track segment includes a third guide surface spaced apart from a fourth guide surface to define a second gap region that movably receives the door guide members from the curved track segment. In this embodiment, the second gap region is wider than the first gap region to reduce binding as the door moves onto the non-vertical track segment.

18 Claims, 10 Drawing Sheets

U.S. PATENT DOCUMENTS 3,484,812 A 12/1969 Holland
3,552,474 A 1/1971 Finnegan
3,693,693 A 9/1972 Court
3,934,635 A 1/1976 Kin
4,016,920 A 4/1977 Shepard
4,080,757 A 3/1978 Westerman
4,120,072 A 10/1978 Hormann et al.
4,155,268 A 5/1979 Lee et al.
4,205,713 A 6/1980 Galbreath
4,352,585 A 10/1982 Spalding
4,379,479 A 4/1983 Whiting
4,478,268 A 10/1984 Palmer et al.
4,572,268 A 2/1986 Wentzel
4,601,320 A 7/1986 Taylor et al.
4,676,293 A 6/1987 Hanssen
4,800,618 A 1/1989 Putz
4,836,589 A 6/1989 Mohr
4,846,245 A 7/1989 Pagliaro et al.
4,934,835 A 6/1990 Albert et al.
5,036,899 A 8/1991 Mullet
5,131,450 A 7/1992 Lichy
5,141,043 A 8/1992 Kraeutler et al.
5,163,495 A 11/1992 Lichy
5,219,015 A 6/1993 Kraeutler et al.
5,222,541 A 6/1993 Hornberger
5,240,216 A 8/1993 Lin et al.
5,271,448 A 12/1993 Delgado
5,291,686 A 3/1994 Sears et al.
5,299,617 A 4/1994 Hying et al.
5,307,855 A 5/1994 Martensson, IV
5,351,742 A 10/1994 Lichy
5,353,473 A 10/1994 Sherick
5,353,859 A 10/1994 Oltahfer et al.
5,365,993 A 11/1994 Jella
5,367,825 A 11/1994 Doring et al.
5,368,084 A 11/1994 Hying et al.
5,404,927 A 4/1995 Bailey
5,408,724 A 4/1995 Mullet et al.
5,409,051 A 4/1995 Mullet et al.
5,445,207 A 8/1995 Romanelli et al.
5,447,377 A 9/1995 Baumgartner et al.
5,522,446 A 6/1996 Mullet et al.
5,533,561 A 7/1996 Forehand, IV
5,535,805 A 7/1996 Kellogg et al.
5,562,141 A 10/1996 Mullet et al.
5,566,740 A 10/1996 Mullet et al.
5,568,672 A 10/1996 Mullet et al.
5,584,333 A 12/1996 Torchetti et al.
5,601,133 A 2/1997 Krupke et al.
5,620,039 A 4/1997 Delgado et al.
5,638,883 A 6/1997 Schulte
5,659,926 A 8/1997 Dietrich
5,718,533 A 2/1998 Mullet et al.
5,720,332 A 2/1998 Nachreiner
5,727,614 A 3/1998 Lichy
5,737,802 A 4/1998 Jella
5,743,317 A 4/1998 Beringer et al.
5,765,622 A 6/1998 Lichy
5,829,504 A 11/1998 Ekstrand et al.
5,887,385 A 3/1999 Horner et al.
5,927,368 A 7/1999 Rohrer et al.
5,927,862 A 7/1999 Debnam et al.
5,944,086 A 8/1999 Gruben et al.
5,946,869 A 9/1999 Zinbarg
5,954,111 A 9/1999 Ochoa
5,957,187 A 9/1999 Gruben et al.
5,992,497 A 11/1999 Jaehnen et al.
6,041,844 A 3/2000 Kellogg et al.
6,047,761 A 4/2000 Jaehnen et al.
6,068,040 A 5/2000 Magro et al.
6,076,590 A 6/2000 Ford et al.
6,082,430 A 7/2000 Mock
6,089,304 A 7/2000 Mullet et al.
6,089,305 A 7/2000 Gruben et al.
6,094,779 A 8/2000 Young
6,095,229 A 8/2000 Kellogg et al.
6,112,464 A 9/2000 Grisham et al.
6,112,799 A 9/2000 Mullet et al.
6,119,307 A 9/2000 Weishar et al.
6,125,506 A 10/2000 Martin
6,148,897 A 11/2000 Horner et al.
6,185,783 B1 2/2001 Carpinella
6,227,281 B1 * 5/2001 Martin ..... 160/201
6,250,360 B1 6/2001 Ochoa
6,263,948 B1 7/2001 Whitley
6,273,175 B1 8/2001 Kellogg et al.
6,315,027 B1 11/2001 Lichy
6,321,822 B1 11/2001 Horner et al.
6,434,886 B1 8/2002 Johnson et al.
6,463,988 B1 10/2002 Mullet et al.
6,481,487 B2 11/2002 Simon et al.
6,527,035 B2 3/2003 Hoofard et al.
6,536,077 B1 3/2003 Espey
6,540,003 B1 4/2003 Martin
6,554,047 B1 4/2003 Mondragon et al.
6,574,832 B1 6/2003 Boerger et al.
6,588,482 B2 7/2003 Wright
6,598,648 B1 7/2003 Schulte
6,612,357 B1 9/2003 Beringer et al.
6,615,898 B2 9/2003 Schulte
6,640,496 B2 11/2003 Mullet
6,640,872 B1 11/2003 Mullet
6,644,378 B2 11/2003 Mitchell
6,659,158 B2 12/2003 Laugenbach et al.
6,698,490 B2 3/2004 Hoerner et al.
6,715,236 B2 4/2004 Mullet
6,715,531 B2 4/2004 Simon et al.
6,729,380 B2 5/2004 Whitley et al.
6,739,372 B2 5/2004 Mullet et al.
6,745,814 B2 6/2004 Hoofard et al.
6,792,998 B2 9/2004 David
6,840,300 B2 1/2005 Lewis, Jr.
6,843,300 B2 1/2005 Mullet et al.
6,918,157 B2 7/2005 Koike et al.
6,951,237 B2 10/2005 Mullet
6,964,289 B2 11/2005 Schulte
7,011,347 B2 3/2006 Finardi et al.
7,055,571 B2 6/2006 Johnston et al.
7,089,990 B2 8/2006 Hormann et al.
7,114,291 B2 10/2006 David
7,114,753 B2 10/2006 Nodorft
7,117,916 B2 10/2006 Johnston et al.
7,128,123 B2 10/2006 Mullet et al.
2005/0205220 A1 * 9/2005 Johnston et al. ..... 160/201

OTHER PUBLICATIONS

"MpactDoor—Panel Features and General Specifications," Aaron-Bradley Company Inc., 1 page, published 2008.

* cited by examiner

OVERHEAD DOORS AND ASSOCIATED TRACK, GUIDE, AND BRACKET ASSEMBLIES FOR USE WITH SAME

CROSS-REFERENCE TO RELATED APPLICATIONS

The present application claims priority to U.S. Provisional Application Ser. No. 60/956,368, filed Aug. 16, 2007, the disclosure of which is incorporated herein by reference in its entirety. The disclosures of the following patent applications are also incorporated herein by reference in their entireties: U.S. Provisional Application Ser. No. 60/956,355, filed Aug. 16, 2007; U.S. Provisional Application Ser. No. 60/956,363, filed Aug. 16, 2007; U.S. application Ser. No. 12/191,118, entitled "OVERHEAD DOORS AND ASSOCIATED TRACK AND GUIDE ASSEMBLIES FOR USE WITH SAME", filed concurrently herewith; and U.S. application Ser. No. 12/191,140, entitled "OVERHEAD DOORS AND ASSOCIATED TRACK GUIDE ASSEMBLIES FOR USE WITH SAME", filed concurrently herewith.

TECHNICAL FIELD

The following disclosure relates generally to overhead doors and, more particularly, to overhead door track, guide, and bracket assemblies.

BACKGROUND

Overhead doors have been used on loading docks and in various other warehouse and factory settings for many years. Conventional overhead doors are of the sectional type, and typically include four or more rectangular panels hinged together along the upper and lower edges. Each of the door panels carries two guide assemblies near the upper hinge line, and the bottom door panel carries two additional guide assemblies near the bottom edge. Each of the guide assemblies typically includes a plunger or roller device that extends outwardly from the door panel and is movably received in a channel section of an adjacent door track. The door tracks extend along the left and right sides of the door, and guide the door as it moves upwardly into the overhead or "open" position.

Many overhead doors include spacers between the door panels for sealing and other reasons. Because the pivot axes of the panel hinges are not collinear with the guide plunger axes, the panel spacers can prevent adjacent door panels from back-bending. This can lead to binding as the door is moved upwardly on curved guide tracks.

Another problem with conventional overhead doors is that they are susceptible to damage when used in factories, warehouses, and other commercial and industrial settings. Occasionally, for example, a forklift operator may inadvertently run into the door, as can happen when the door is in a partially open position. This can damage the door and/or the door tracks, making further use of the door difficult or impossible without time-consuming repairs. One way to overcome this problem is to equip the door with spring-loaded guide assemblies that retract and release from the tracks when struck with sufficient force in one or more directions, as disclosed in, for example, U.S. Pat. No. 5,535,805 to Kellog, et al., U.S. Pat. No. 5,927,368 to Rohrer, et al., U.S. Pat. No. 6,041,844 to Kellog, et al., U.S. Pat. No. 6,095,229 to Kellog, et al., U.S. Pat. No. 6,119,307 to Weishar, et al., and U.S. Pat. No. 6,273,175 to Kellog, et al. (All of the foregoing patents are incorporated into the present disclosure in their entireties by reference).

Although configuring the door to release in one or both directions may avoid damage to the door when struck, this approach can present additional problems. For example, under certain conditions the entire door could be knocked out of the tracks, and reinstalling an entire door can be a difficult and time-consuming task. Furthermore, one or more spreader bars may be necessary to help hold the overhead door tracks in position.

SUMMARY

The following summary is provided for the benefit of the reader only, and is not intended to limit the invention as set forth by the claims in any way.

The present disclosure is directed generally to overhead door track assemblies and associated backhang brackets. An overhead door track assembly configured in accordance with one aspect of the invention includes a vertical track segment mounted to a wall adjacent an opening therein, and a non-vertical track segment having a proximal end operably coupled to the vertical track segment and a distal end spaced apart from the wall. The non-vertical track segment can include a first side portion spaced apart from a second side portion to define a guide channel therebetween. The guide channel is configured to movably receive at least one door guide member as the door moves away from the opening toward the distal end of the non-vertical track segment. In this aspect of the invention, the track assembly further includes a bracket, e.g., a "backhang" bracket, supporting the distal end of the non-vertical track segment. The bracket is fixedly attached to the first and second side portions of the non-vertical track segment and spans across at least a portion of the guide channel near the distal end of the non-vertical track segment.

A door track assembly configured in accordance with another aspect of the invention includes a vertical track segment, a curved track segment, and a non-vertical track segment. The vertical track segment can be mounted to a wall adjacent an opening therein. The curved track segment can be operably coupled to the vertical track segment, and can include a first guide surface spaced apart from a second guide surface to define a first gap region therebetween. The first gap region can be configured to movably receive at least one door guide member as the door moves away from the opening. The non-vertical track segment can include a proximal end operably coupled to the curved track segment and a distal end spaced apart from the wall. The non-vertical track segment can further include a third guide surface spaced apart from a fourth guide surface to define a second gap region therebetween. In this aspect of the invention, the second gap region can be wider than the first gap region to prevent or at least reduce binding of the at least one door guide member as the door moves from the curved track segment toward the distal end of the non-vertical track segment.

DETAILED DESCRIPTION

The following disclosure describes various embodiments of overhead door tracks, track support brackets (e.g., "backhang" brackets), and associated door guide assemblies. In one embodiment, for example, an overhead door track has a guide channel that widens as the track curves away from the door opening to prevent, or at least reduce door binding. In another embodiment, a door track backhang bracket spans across the guide channel to act as a secondary door stop mechanism. Certain details about these and other embodiments are set forth in the following description and in FIGS. 1-11B to provide a thorough understanding of various embodiments of the invention. Other details describing well-known structures and systems often associated with overhead doors, overhead door tracks, and overhead door guide assemblies, have not been set forth in the following disclosure to avoid unnecessarily obscuring the description of the various embodiments of the invention.

Many of the details, dimensions, angles and other features shown in the Figures are merely illustrative of particular embodiments of the disclosure. Accordingly, other embodiments can have other details, dimensions, angles and features without departing from the spirit or scope of the present invention. In addition, those of ordinary skill in the art will appreciate that further embodiments of the invention can be practiced without several of the details described below.

In the Figures, identical reference numbers identify identical, or at least generally similar elements. To facilitate the discussion of any particular element, the most significant digit or digits of any reference number refer to the Figure in which that element is first introduced. For example, element 110 is first introduced and discussed with reference to FIG. 1.

Figure 1:
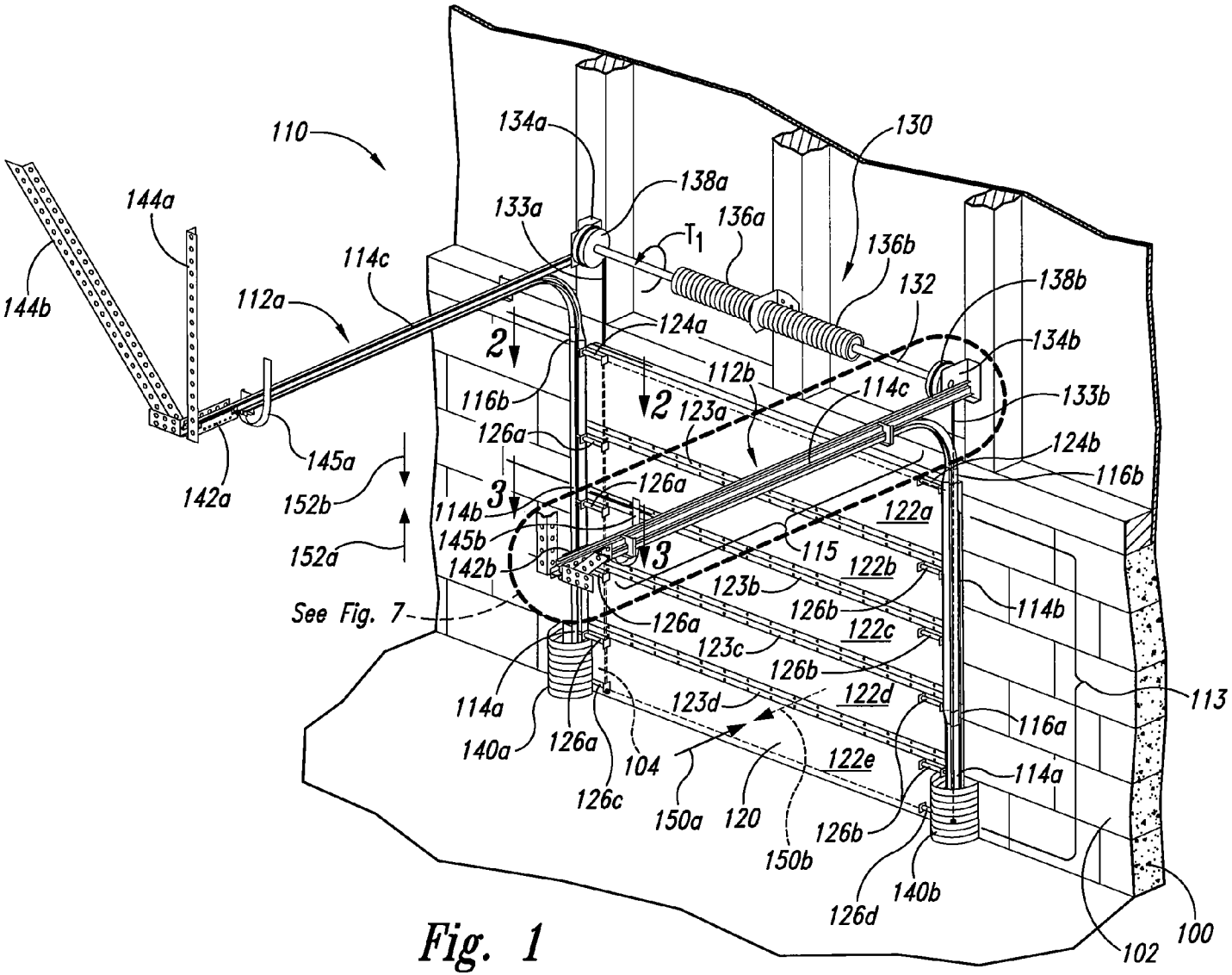
FIG. 1 is an isometric view of an overhead door assembly configured in accordance with an embodiment of the invention.

FIG. 1 is an isometric view of an overhead door assembly 110 configured in accordance with an embodiment of the invention. The overhead door assembly 110 ("door assembly 110") is installed in an opening 104 in a wall 102 of a building 100. The wall 102 can be part of a loading dock in a warehouse, factory, or other building 100. In other embodiments, however, the door assembly 110 can be installed in other types of openings in other commercial and non-commercial buildings.

The overhead door assembly 110 includes a sectional door 120 that is movably supported in opposing track assemblies 112 (identified individually as a left or first track assembly 112*a* and a right or second track assembly 112*b*). The sectional door 120 includes a plurality of rectangular door panels 122 (identified individually as door panels 122*a-e*) which are pivotally attached to each other along hinge lines 123 (identified individually as hinge lines 123*a-d*). In one aspect of this embodiment, the first door panel 122*a* carries a first interlocking guide assembly 124*a* that movably engages the first track assembly 112*a*, and a second interlocking guide assembly 124*b* that movably engages the second track assembly 112*b*. Each of the remaining door panels 122*b-e* carries a first releasable guide assembly 126*a* that movably engages the first track assembly 112*a* at least proximate to the upper hinge line 123, and a second releasable guide assembly 126*b* that movably engages the second track assembly 112*b* at least proximate to the upper hinge line 123. In addition, the fifth door panel 122*e* carries a third releasable guide assembly 126*c* that movably engages the first track assembly 112*a* at least proximate to a lower edge of the door panel 122*e*, and a fourth releasable guide assembly 126*d* that movably engages the second track assembly 112*b* at least proximate to the lower edge of the door panel 122*e*.

In other embodiments, overhead doors configured in accordance with the present disclosure can include other guide assembly arrangements that differ from that illustrated in FIG. 1. For example, in another embodiment, each of the door panels 122*a-d* can utilize the interlocking guide assemblies 124, and only the lowermost door panel 122*e* can utilize the releasable guide assemblies 126. In yet another embodiment, all of the door panels 122 can utilize the interlocking guide assemblies 124. Accordingly, the invention is not limited to the particular guide assembly configuration illustrated in FIG. 1.

In one aspect of this embodiment, the interlocking guide assemblies 124 can include an "interlocking" guide member that is retained in the adjacent track section when subjected to a force in an outward or first direction 150*a* or an inward or second direction 150*b*. In contrast, the releasable guide assemblies 126 can include a "releasable" guide member that disengages from the adjacent track section (thereby allowing the corresponding door panel 122 to be "knocked-out") when subjected to a sufficient force in one or both of the first direction 150*a* and/or the second direction 150*b*. These and other details of the guide assemblies 124 and 126 are described in greater detail below with reference to, for example, FIGS. 2 and 3.

In the illustrated embodiment, each of the track assemblies 112 includes a vertical track segment 113 secured to the wall 102 proximate the opening 104, and a non-vertical track segment 115 which extends away from the wall 102 above the door opening 104. A guard rail 140, or a similar type of protective structure, can be installed around the lower portion of each of the vertical track segments 113 to protect it from damage from forklifts or other impacts. The distal end of each of the non-vertical track segments 115 can be attached to an overhead support system 144 by a corresponding backhang bracket 142 (identified individually as a first backhang bracket 142*a* and a second backhang bracket 142*b*). The support system 144 can include a vertical member 144*a* and a diagonal member 144*b* having distal ends that are fixedly attached to adjacent building structures for support. A door bumper 145, made of spring steel or other suitable material, can be fixedly attached near the distal end of each of the non-vertical track segments 115 to act as a primary door travel stop system and absorb the kinetic energy of the door 120 as it moves into the overhead position.

Each of the track assemblies 112 includes a plurality of multi-piece track sections 114 (identified individually as a first track section 114*a*, a second track section 114*b*, and a third track section 114*c*) operably coupled together in functional alignment at a first transition section 116*a* and a second transition section 116*b*. In one aspect of this embodiment, each of the track sections 114*a-c* has a different cross-sectional shape that provides different door knock-out capabilities at different locations along the track. For example, in the illustrated embodiment, the cross-sectional shape of the first track section 114*a* allows the releasable guide assemblies 126 to disengage from the track section 114*a* when subjected to a force of a predetermined magnitude in the first direction 150*a*. This same cross-sectional shape, however, does not allow the releasable guide assemblies 126 to disengage from the first track section 114*a* when subjected to a force in the opposite, second direction 150*b*.

Turning now to the second track section 114*b*, this track section has a cross-sectional shape that allows the releasable guide assemblies 126 to disengage when subjected to a force of sufficient magnitude in either the first direction 150*a* or the second direction 150*b*. The third track section 114*c* has yet another cross-sectional shape that differs from both the first track section 114*a* and the second track section 114*b*. More specifically, the third track section 114*c* has a cross-sectional shape (or shapes) that retains both the releasable guide assemblies 126 and the interlocking guide assemblies 124 when the door 120 is in the overhead position, even when the door 120 is subjected to a substantial force in an upward or third direction 152*a* or a downward or fourth direction 152*b*. These and other features of the track sections 114 are described in greater detail below with reference to FIGS. 2-11B.

In a further aspect of this embodiment, the overhead door assembly 110 also includes a counterbalance system 130 fixedly attached to the building 100 above the door opening 104. The counterbalance system 130 can include a first cable 133*a* and a second cable 133*b* which are attached to the lower-most door panel 122*e*. The counter balance cables 133 may also be attached to other door panels 122 at the top or bottom. Each of the cables 133 is operably coupled to a corresponding cable drum 138 (identified individually as a first cable drum 138*a* and a second cable drum 138*b*). The cable drums 138 are fixedly attached to an axle 132 which is rotatably supported by opposing bearing supports 134*a* and 134*b*. A first coil spring 136*a* and a second coil spring 136*b* are operably wound about the axle 132, and exert a torsional force $T_1$ on the cable drums 138 which is proportional to the amount of cable extension. The torsional force $T_1$ puts the cables 133 in tension, making it easier for a person to lift the door 120 and allowing the door 120 to close or lower at a controlled rate of speed In operation, a person wishing to open the door 120 simply grasps the door 120 and lifts after disengaging any door locks (not shown). As the door 120 moves upwardly, the door panels 122 curve around the bends in the third track sections 114*c* and move inwardly on the non-vertical track segments 115 toward the bumpers 145. Although not shown in FIG. 1, in an alternate embodiment the overhead door assembly 110 can be equipped with an electric motor or other automated device for opening the door 120. With the door 120 stowed in the overhead position, personnel can transport goods and materials through the opening 104 by forklift, dolly, or other conveyance.

In the embodiment of FIG. 1, the door 120 moves upwardly and then away from the wall 102 in a horizontal direction. In other embodiments, however, an overhead door configured in accordance with the present disclosure can move away from the opening 104 in multiple directions. For example, the door 120 can move along tracks that extend away from the wall 102 at any angle from about 0 degrees (i.e., parallel to the wall 102) to about 90 degrees (i.e., horizontal, as shown in FIG. 1). Accordingly, those of ordinary skill in the relevant art will appreciate that the present invention is not limited to the particular embodiment disclosed in FIG. 1, but extends to other embodiments incorporating the inventive features disclosed herein.

Figure 2:
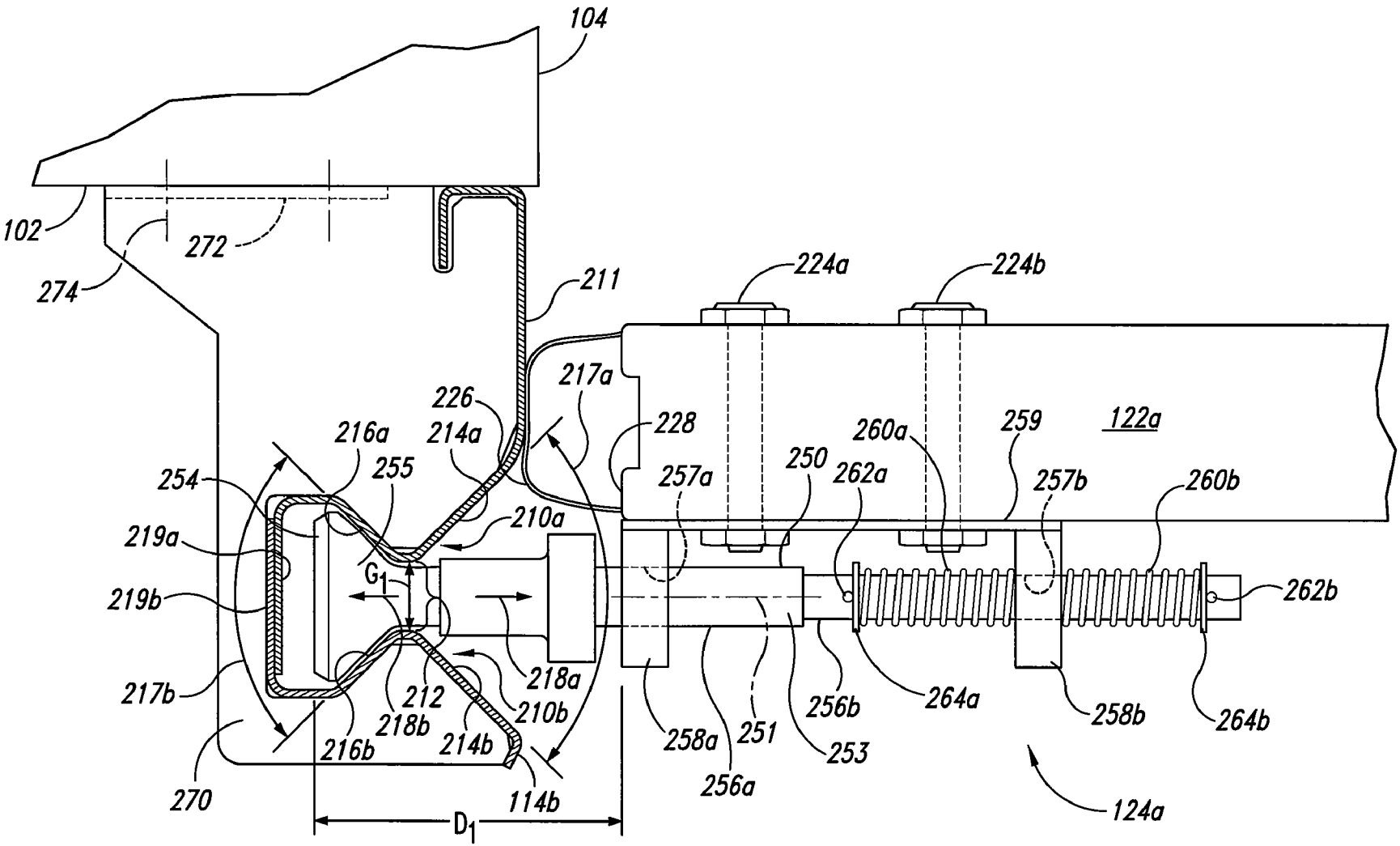
FIG. 2 is an enlarged, cross-sectional end view of a track section and guide assembly configured in accordance with an embodiment of the invention.

FIG. 2 is an enlarged, cross-sectional end view taken along line 2-2 in FIG. 1, showing the interlocking guide assembly 124*a* movably engaged with the second track section 114*b* in accordance with an embodiment of the invention. In one aspect of this embodiment, the second track section 114*b* is formed from two separate side portions 210 (identified individually as a first side portion 210*a* and a second side portion 210*b*) which are joined together along overlapping flanges 219 (identified individually as a first flange 219*a* and a second flange 219*b*). In one embodiment, the flanges 219 can be joined together by a plurality of "clinched" connections formed by a process known as "clinching." Clinching is a method of joining two pieces of sheet metal by pressing them together with a die that forms a connection similar to a rivet. Hand operated clinching tools are typically hydraulically driven, and make a connection by driving a punch into the die through overlapping material. When the material is forced to the bottom of the die, the material begins to mushroom and expands to allow full development of the connection. When the punch reaches its force limit, it is withdrawn. The result is a connection very similar to a riveted connection. In other embodiments, however, the flanges 219 can be joined together using a number of different techniques including, for example, fastening with rivets, screws, bolts, etc., bonding, welding, and/or other suitable methods known in the art.

The first side portion 210*a* is spaced apart from the second side portion 210*b* to define a first gap region 212 therebetween. The first gap region 212 has a first width or first gap dimension $G_1$. The first side portion 210*a* includes a first guide surface 214*a* and a first retention surface 216*a*. Similarly, the second side portion 210*b* includes a second guide surface 214*b* and a second retention surface 216*b*. In the illustrated embodiment, the first and second guide surfaces 214 diverge from the first gap region 212 in a fifth direction 218*a* to form a first "V-groove," and the first and second retention surfaces 216 diverge from the first gap region 212 in a sixth direction 218*b*, opposite to the fifth direction 218*a*, to form a second "V-groove." More specifically, in the illustrated embodiment, the first guide surface 214*a* is disposed at a first angle 217*a* of from about 60 degrees to about 120 degrees, e.g., about 90 degrees relative to the second guide surface 214*b*. The first retention surface 216*a* can be disposed at a second angle 217*b* of from about 40 degrees to about 180 degrees relative to the second retention surface 216*b*. For example, in one embodiment the first retention surface 216*a* can be disposed at a second angle 217*b* of from about 60 degrees to about 160 degrees, e.g., about 120 degrees relative to the second retention surface 216*b*. As described in greater detail below, however, in other embodiments the first and second guide surfaces 214, and/or the first and second retention surfaces 216, can be disposed at other angles, or be parallel, relative to each other.

In addition to the foregoing surfaces, the second track section 114*b* further includes a seal surface 211 extending from the first guide surface 214*a*. As illustrated in FIG. 2, the first door panel 122*a* carries a compressible door seal 226 that slideably contacts the seal surface 211. The door seal 226 can be manufactured from rubber, polyurethane, foam, and/or any other suitable material known in the art.

In one embodiment, the side portions 210 can be formed with a brake press from a suitable sheet metal, such as galvanized steel having a thickness ranging from about 10 gauge to about 20 gauge, e.g. about 16 gauge. In other embodiments, the side portions 210 can be roll- or press-formed from a suitable sheet metal. One advantage of making the track sections 114 from two (or more) pieces of formed sheet metal is that the individual side portions 210 have shapes that are relatively easy to form by conventional brake- and roll-forming methods. In further embodiments, however, the side portions 210, and/or other overhead door track components embodying the inventive features disclosed herein, can be machined, cast, or otherwise formed from other metallic and non-metallic materials having suitable strength, stiffness, forming, cost, and/or other characteristics. Accordingly, those of ordinary skill in the art will appreciate that aspects of the present invention are not limited to the particular manufacturing methods disclosed herein.

In another aspect of this embodiment, the interlocking guide assembly 124*a* includes an interlocking guide member 250 that projects outwardly from a door edge region 228 a distance $D_1$ along a longitudinal axis 251 of the guide member 250. The interlocking guide member 250 includes a cylindrical shaft 253 having a first shaft portion 256*a* and a smaller-diameter second shaft portion 256*b*. The first shaft portion 256*a* extends through a first aperture 257*a* in a first journal 258*a*. The second shaft portion 256*b* extends from the first shaft portion 256*a* through a coaxial second aperture 257*b* in a second journal 258*b*. The journals 258 are carried by a bracket 259 which is fixedly attached to the first door panel 122*a* by a plurality of bolts 224 or other suitable fasteners and/or methods known in the art.

In a further aspect of this embodiment, the distal end of the first shaft portion 256*a* carries an enlarged head portion 254 that is movably retained by the retention surfaces 216 of the second track section 114*b*. In the illustrated embodiment, the enlarged head portion 254 flares outwardly from the first shaft portion 256*a* to form a reverse conical, or at least generally conical, surface 255. Moreover, in the illustrated embodiment the angle of the surface 255 is at least generally similar, or at least approximately parallel, to the angle 217*b* between the adjacent retention surfaces 216.

In one embodiment, the first shaft portion 256*a* can have a diameter of from about 0.25 inch to about 0.75 inch, e.g., about 0.50 inch, and the first gap dimension $G_1$ can be from about 0.375 inch to about 0.875 inch, e.g., about 0.625 inch to provide sufficient clearance for the first shaft portion 256*a* while still retaining the enlarged head portion 254. In other embodiments, however, other configurations of interlocking guide members and associated track sections can be employed without departing from the spirit or scope of the present disclosure. For example, in other embodiments consistent with the present disclosure, the enlarged head portion 254 can have other shapes, such as spherical shapes, cylindrical shapes, etc., and the adjacent track surfaces can have other shapes that may or may not reflect the shape of the enlarged head portion. In still further embodiments, interlocking guide members can include rollers or similar devices attached to the distal end of the first shaft portion 256*a* to function as the enlarged head portion 254. As the foregoing illustrates, the present invention is not limited to the particular interlocking guide assembly illustrated in FIG. 2, but extends to other embodiments incorporating the various features disclosed herein.

In another aspect of this embodiment, the second shaft portion 256*b* carries first and second coil springs 260*a, b* which are compressed against opposite sides of the second journal 258*b* and held in place by washers 264 and associated pins 262. The coil springs 260 permit the guide member 250 to move back and forth along the longitudinal axis 251 a preset distance, such as from about 0.1 inch to about 0.5 inch, e.g., about 0.25 inch. This movement enables the guide member 250 to accommodate minor misalignments of the track section 114*b* without binding.

A track bracket 270 fixedly attaches the second track section 114*b* to the wall 102. In one aspect of this embodiment, the track bracket 270 can include a mounting flange 272 through which one or more fasteners 274 extend to attach the track bracket 270 to the wall 102.

Figure 3:
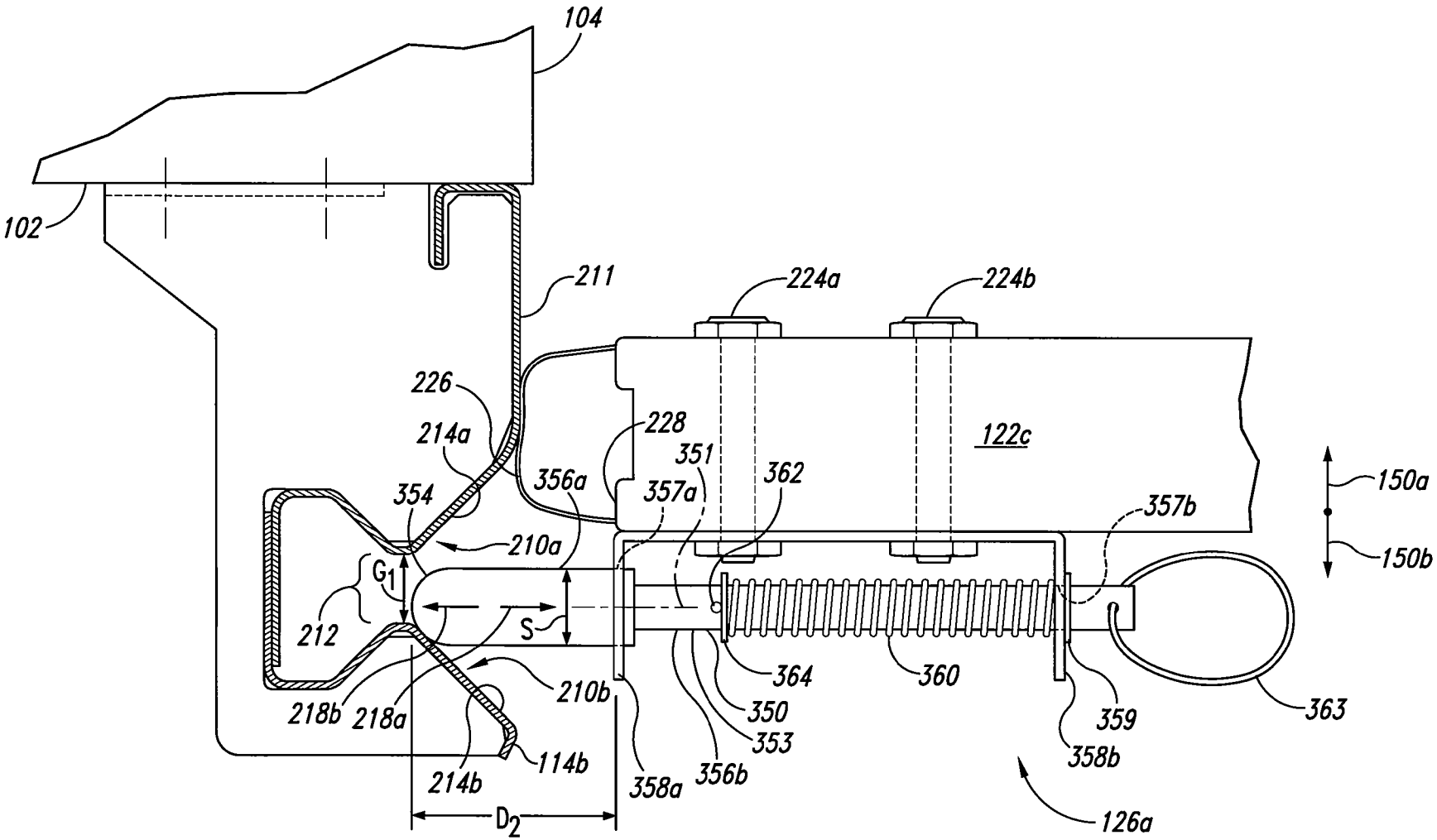
FIG. 3 is an enlarged, cross-sectional end view of a track section and guide assembly configured in accordance with another embodiment of the invention.

FIG. 3 is an enlarged, cross-sectional end view taken along line 3-3 in FIG. 1, illustrating engagement of the releasable guide assembly 126*a* with the second track section 114*b*. The various track section and door panel features described above with reference to FIG. 2 apply to FIG. 3 as well. As can be seen from FIG. 3, however, in this particular embodiment the releasable guide assembly 126*a* includes a releasable guide member 350 that lacks the enlarged head portion 254 of the interlocking guide member 250 described above.

The releasable guide member 350 projects outwardly from the door edge region 228 along a longitudinal axis 351, and includes a cylindrical shaft 353 having a first shaft portion 356*a* and a smaller-diameter second shaft portion 356*b*. The first shaft portion 356*a* slidably extends through a first aperture 357*a* in a first journal 358*a*. The second shaft portion 356*b* extends from the first shaft portion 356*a* through a coaxial second aperture 357*b* in a second journal 358*b*. The second shaft portion 356*b* passes through a coil spring 360 that is compressed between the second journal 358*b* and a washer 364 which is held in place by a pin 362. The washer 364 and the pin 362 can be replaced by an E-ring or other suitable retainer.

The first shaft portion 356*a* has a constant, or at least approximately constant, diameter S until it reaches a hemispherical, or at least approximately hemispherical head portion 354. The diameter S can be from about 0.50 inch to about 1.0 inch, e.g., about 0.75 inch. In the illustrated embodiment, the first gap dimension $G_1$ is smaller than the diameter S (e.g., the first gap dimension $G_1$ can be about 0.625 inch) to prevent interference of the head portion 354 with the first gap region 212 during door operation. If this were to happen, it could impede the knock-out capability of the releasable guide member 350. The first shaft portion 356*a*, or parts thereof, can be made from a suitable polymer material, such as plastic, Delrin®, Teflon®, etc. to reduce friction between it and the track section 114*b*.

The coil spring 360 urges the first shaft portion 356*a* outwardly in the sixth direction 218*b* toward the second track section 114*b*. An E-ring or other type of retainer 359 is fixedly attached to the second shaft portion 356*b*, however, to prevent the head portion 354 from projecting beyond a distance $D_2$ from the edge region 228 of the door panel 122*c*. The distance $D_2$ is less than the distance $D_1$ discussed above with reference to FIG. 2. As described in greater detail below, the coil spring 360 allows the head portion 354 to move inwardly in the fifth direction 218*a* a preset distance, such as from about 0.5 inches to about 1.5 inches, e.g., about 1.25 inches.

The releasable guide member 350 allows the third door panel 122*c* to be disengaged or "knocked-out" of the second track section 114*b* when a force of sufficient magnitude is exerted against the door panel 122*c* in the outward or first direction 150*a* or the inward or second direction 150*b*. For example, when the door panel 122*c* is subjected to a force of sufficient magnitude in the first direction 150*a*, the force causes the rounded head portion 354 of the guide member 350 to bear against the first guide surface 214*a*. The angle of the guide surface 214*a* causes the guide member 350 to retract inwardly in the fifth direction 218*a* as the door panel 122*c* continues moving outwardly in the first direction 150*a*. Once the head portion 354 is sufficiently retracted, the releasable guide member 350 moves free of the "V-groove" formed by the guide surfaces 214. The releasable guide assembly 126*a* can further include a D-ring or other type of pull feature 363 for manually retracting the releasable guide member 350 if desired to facilitate door panel installation, reinstallation, or removal.

Figure 4:
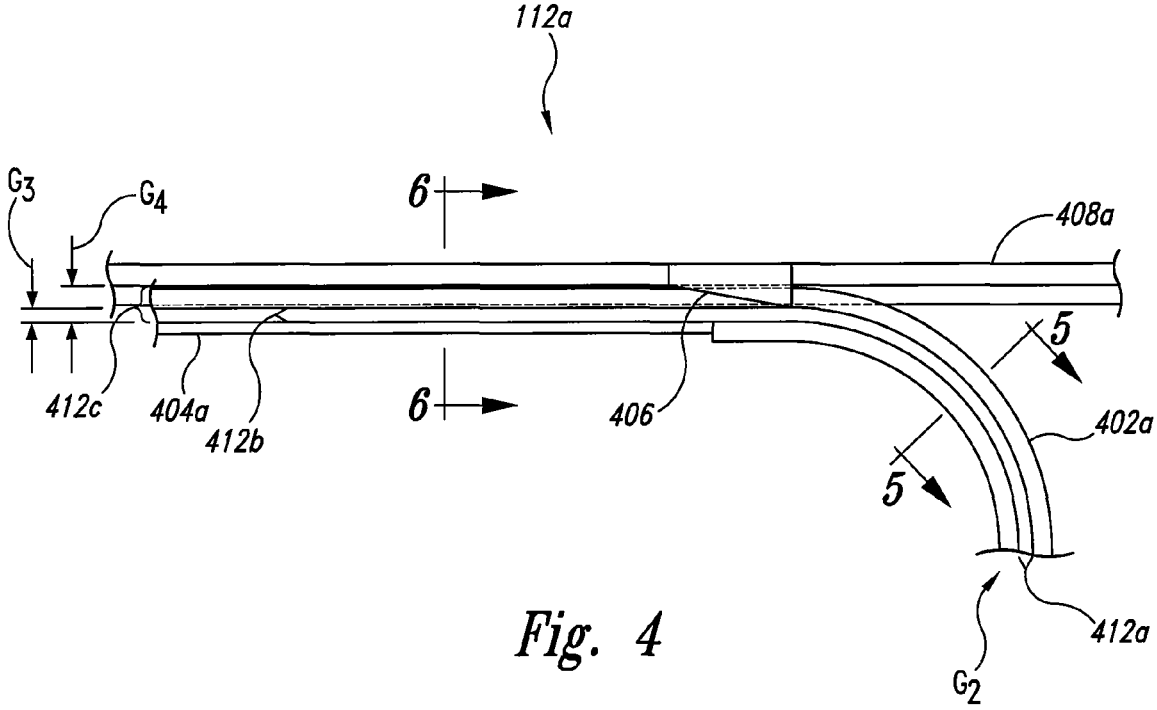
FIG. 4 is an enlarged side view of a portion of the door track assembly of FIG. 1.

FIG. 4 is an enlarged side view of a portion of the first track assembly 112*a* of FIG. 1, configured in accordance with an embodiment of the invention. In one aspect of this embodiment, the first track assembly 112*a* includes a first curved track segment 402*a* and a first non-vertical track segment 404*a*. The non-vertical track segment 404*a* includes a first track brace 408*a* which extends toward the wall 102 of the building 100 (FIG. 1). The curved track segment 402*a* includes a second gap region 412*a* having a second gap dimension $G_2$. The non-vertical track segment 404*a* includes the third gap region 412*b* and a fourth gap region 412*c*. The third gap region 412*b* has a third gap dimension $G_3$, and the fourth gap region 412*c* has a fourth gap dimension $G_4$. The track assembly 112*a* further includes a transition section 406 to accommodate the step up from the second gap region 412*a* of the curved track segment 402*a* to the fourth gap region 412*c* of the non-vertical track segment 404*a*.

As described in greater detail below with reference to FIG. 5, the second gap region 412*a* in the curved track segment 402*a* movably receives the interlocking guide member 250 and the releasable guide member 350 (FIGS. 2 and 3, respectively) as the door 120 moves away from the opening 104 (FIG. 1). As described in greater detail below with reference to FIGS. 6A and 6B, however, as the door 120 moves onto the non-vertical track segment 404*a*, only the third gap region 412*b* receives the interlocking guide member 250. The releasable guide member 350, on the other hand, is free to move within the wider fourth gap region 412*c*. The increased width of the fourth gap region 412*c* enables the door panels 122 (FIG. 1) to move into the overhead position without binding.

Figure 5:
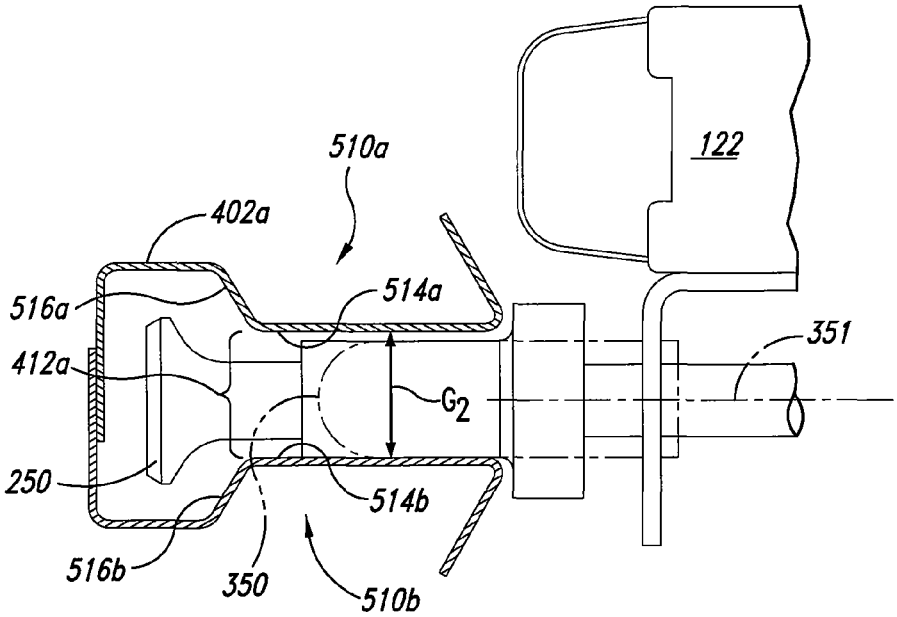
FIG. 5 is an enlarged, cross-sectional end view of a track section and two different door guide assemblies configured in accordance with further embodiments of the invention.

FIG. 5 is an enlarged, cross-sectional end view taken along line 5-5 in FIG. 4. This view illustrates the interlocking guide member 250 and the releasable guide member 350 (shown in phantom line) movably received in the second gap region 412*a* of the curved track segment 402*a*. In one aspect of this embodiment, the second gap region 412*a* defines a guide channel that extends between a third side portion 510*a* and a fourth side portion 510*b*. The third side portion 510*a* includes a third guide surface 514*a* and a third retention surface 516*a*. Similarly, the fourth side portion 510*b* includes a fourth guide surface 514*b* and a fourth retention surface 516*b*. The guide surfaces 514 extend parallel, or at least approximately parallel, to the longitudinal axis 351 of the releasable guide member 350 (FIG. 3) to prevent the releasable guide member 350 from being knocked out of the curved track segment 402 during door operation. The retention surfaces 516 are at least generally similar in structure and function to the retention surfaces 216 described above with reference to FIG. 2. In the illustrated embodiment, the second gap dimension $G_2$ can be slightly larger than the first gap dimension $G_1$ shown in FIGS. 2 and 3, to reduce skidding and/or scuffing of the releasable guide member 350 and the interlocking guide member 250 as they move through the second gap region 412*a*. For example, the second gap dimension $G_2$ can be from about 0.625 inch to about 1.125 inches, e.g., about 0.875 inch. In other embodiments, however, the second gap region 412*a* can have other dimensions.

Figure 6A:
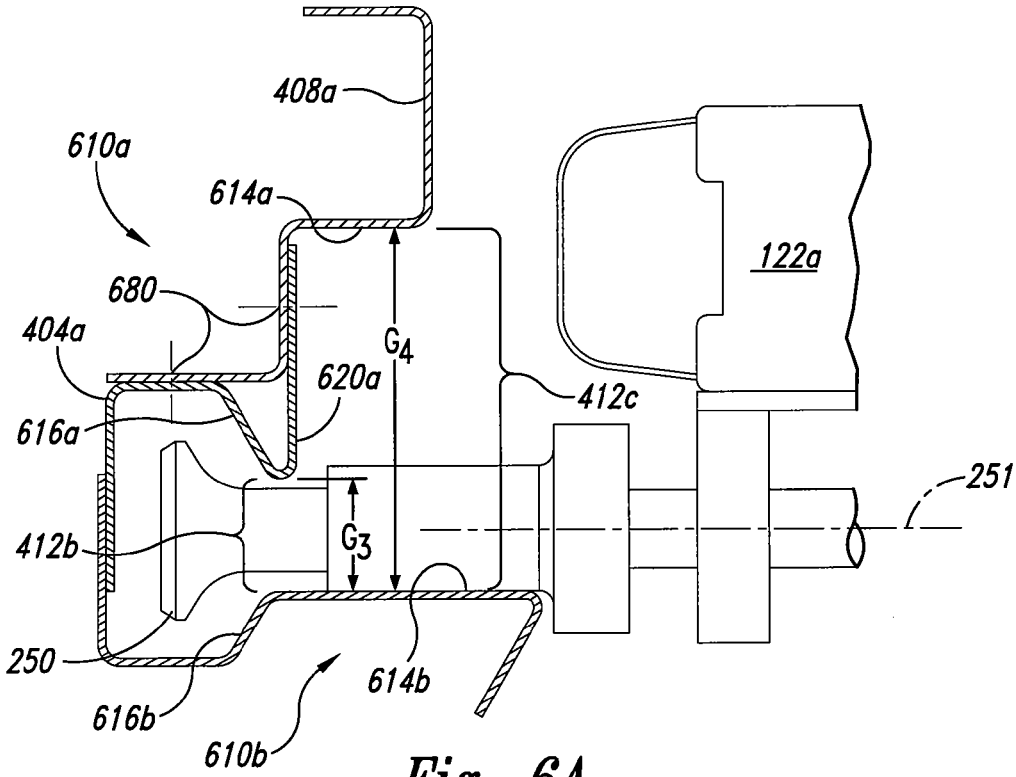
FIGS. 6A and 6B are enlarged, cross-sectional end views of a track section and two different door guide assemblies configured in accordance with additional embodiments of the invention.
Figure 6B:
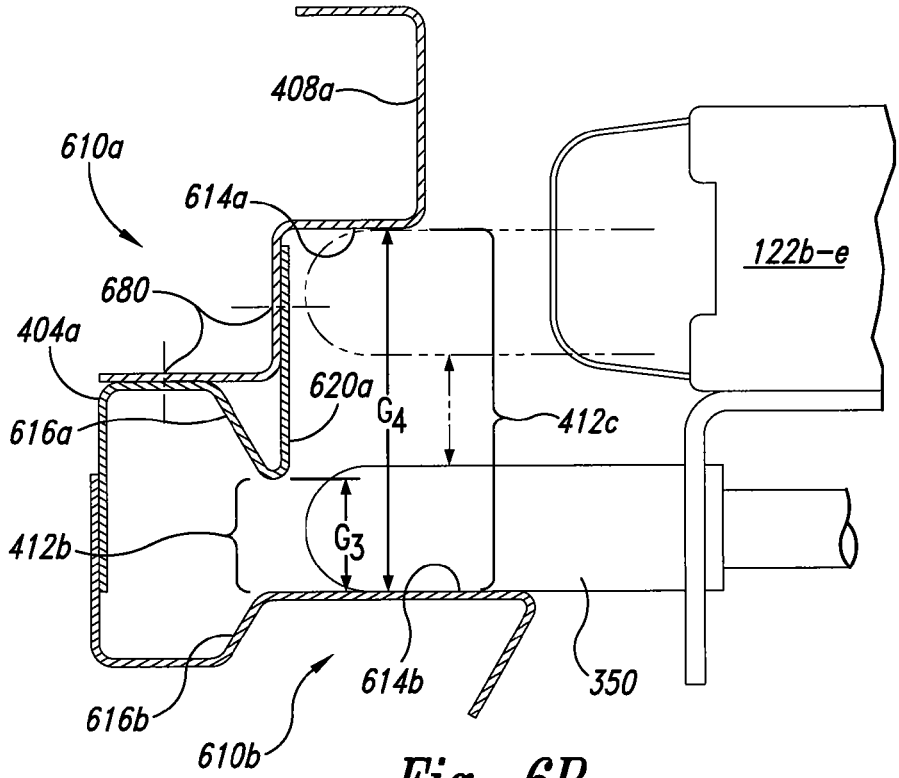

FIGS. 6A and 6B are enlarged, cross-sectional end views taken along line 6-6 in FIG. 4. More specifically, FIG. 6A shows the interlocking guide member 250 movably engaged with the non-vertical track segment 404*a*, and FIG. 6B shows the releasable guide member 350 movably engaged with the non-vertical track segment 404*a*. Referring first to FIG. 6A, the non-vertical track segment 404*a* includes a fifth side portion 610*a* spaced apart from a sixth side portion 610*b*. The fifth side portion 610*a* includes a fifth guide surface 614*a* and a fifth retention surface 616*a*. The sixth side portion 610*b* includes a sixth guide surface 614*b* and a sixth retention surface 616*b*. When the non-vertical track segment 404*a* is operably connected to the curved track segment 402*a* (FIG. 4), the fifth retention surface 616*a* is at least approximately aligned with the third retention surface 516*a* (FIG. 5), the sixth retention surface 616*b* is at least approximately aligned with the fourth retention surface 516*b*, and the sixth guide surface 614*b* is at least approximately aligned with the fourth guide surface 514*b*.

In one aspect of this embodiment, the third gap region 412*b* extends between the sixth side portion 610*b* and a first upper track rail 620*a* that is fastened or otherwise attached to the track brace 408*a*. The upper track rail 620*a* can be fastened to the track brace 408*a* by a plurality of mechanically "clinched" connections 680, or by other suitable fastening techniques known in the art. In another aspect of this embodiment, the fourth gap region 412*c* extends between the fifth guide surface 614*a* and the sixth guide surface 614*b*. The guide surfaces 614 extend at least approximately parallel to the longitudinal axis 251 of the interlocking guide member 250.

Figure 7:
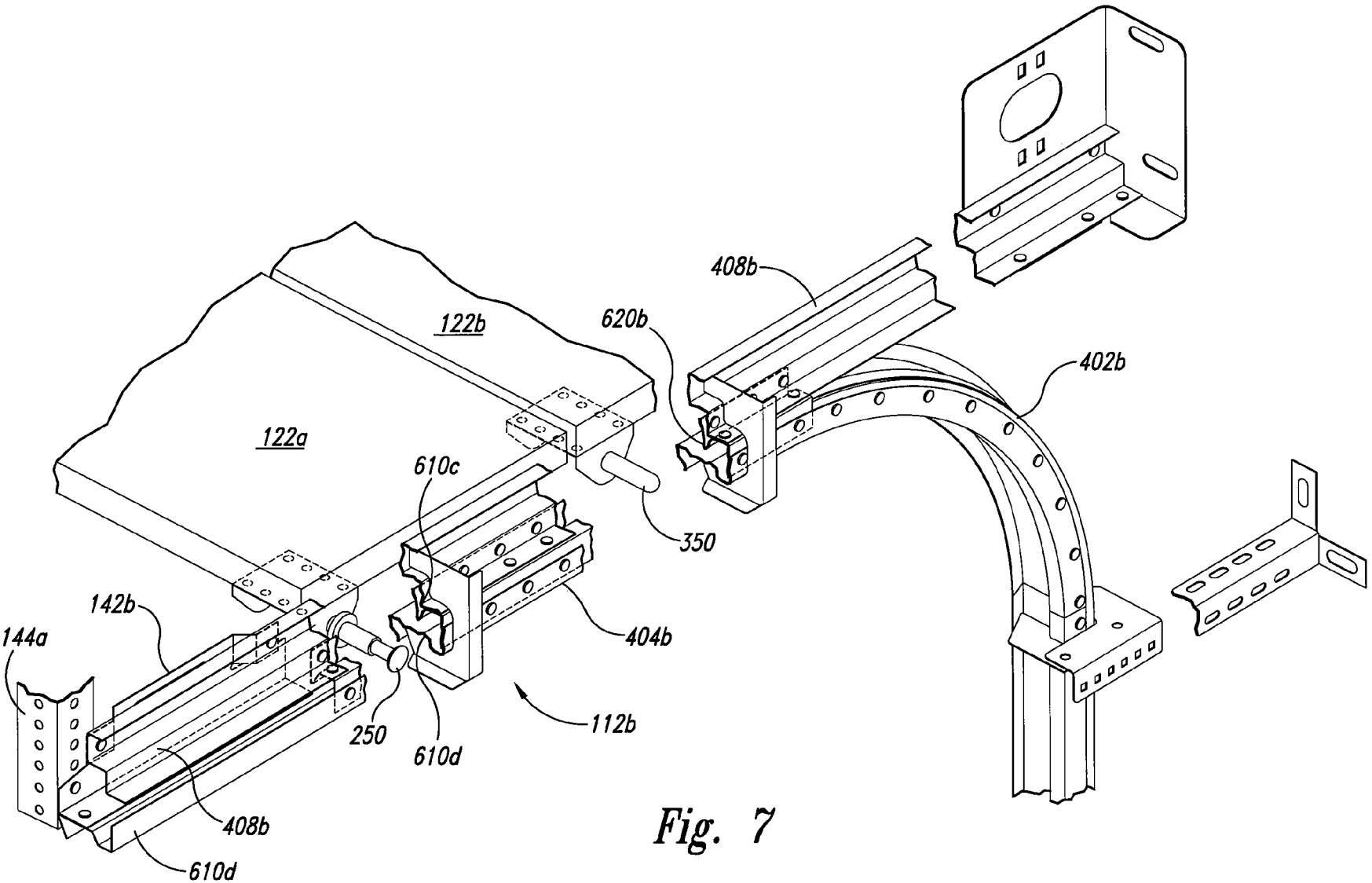
FIG. 7 is a partially cut-away, enlarged isometric view of a portion of the door track assembly of FIG. 1.

During normal door operation, the interlocking guide member 250 moves back and forth in the third gap region 412*b*, but is held in the non-vertical track segment 404*a* by the retention surfaces 616. As shown in FIG. 6B, however, the releasable guide member 350 not only moves back and forth, but it can also move up and down in the fourth gap region 412*c* because of the enlarged fourth gap dimension $G_4$. This freedom of movement can alleviate binding as the door moves from the curved track segment 402*a* (FIG. 4) to the non-vertical track segment 404*a*. More specifically, conventional doors may bind during retraction because spacers between the adjacent door panels prevent them from back-bending as necessary as they move from the curved track segments to the non-vertical track segments. In contrast, the guide channel of the present invention enables doors to move smoothly through curved track segments by providing additional clearance for the releasable guide members 350. In the illustrated embodiment, the third gap dimension $G_3$ can be slightly smaller than the second gap dimension $G_2$ shown in FIG. 5, to prevent the releasable guide member 350 from extending through the third gap region 412*b* during normal door operation. For example, the third gap dimension $G_3$ can be from about 0.375 inch to about 0.875 inch, e.g., about 0.625 inch. In other embodiments, however, the third gap region 412*b* can have other dimensions FIG. 7 is an enlarged, partially cut-away isometric view of a portion of the second track assembly 112*b* of FIG. 1. The second door bumper 145*b* of FIG. 1 has been omitted from FIG. 7 for purposes of clarity. The second track assembly

112*b* is, in general at least, a mirror image of the first track assembly 112*a* described in detail above. Accordingly, the second track assembly 112*b* is at least generally similar in structure and function to the first track assembly 112*a*. For example, the second track assembly 112*b* includes a second curved track segment 402*b* operably connected to a second non-vertical track segment 404*b*. The non-vertical track segment 404*b* includes a second track brace 408*b* which is attached to the wall 102 (FIG. 1). The non-vertical track segment 404*b* includes a seventh side portion 610*c* spaced apart from an eighth side portion 610*d*. The seventh side portion 610*c* is formed by a second upper track rail 620*b* that is fastened or otherwise attached to the second track brace 408*b*.

Figure 8:
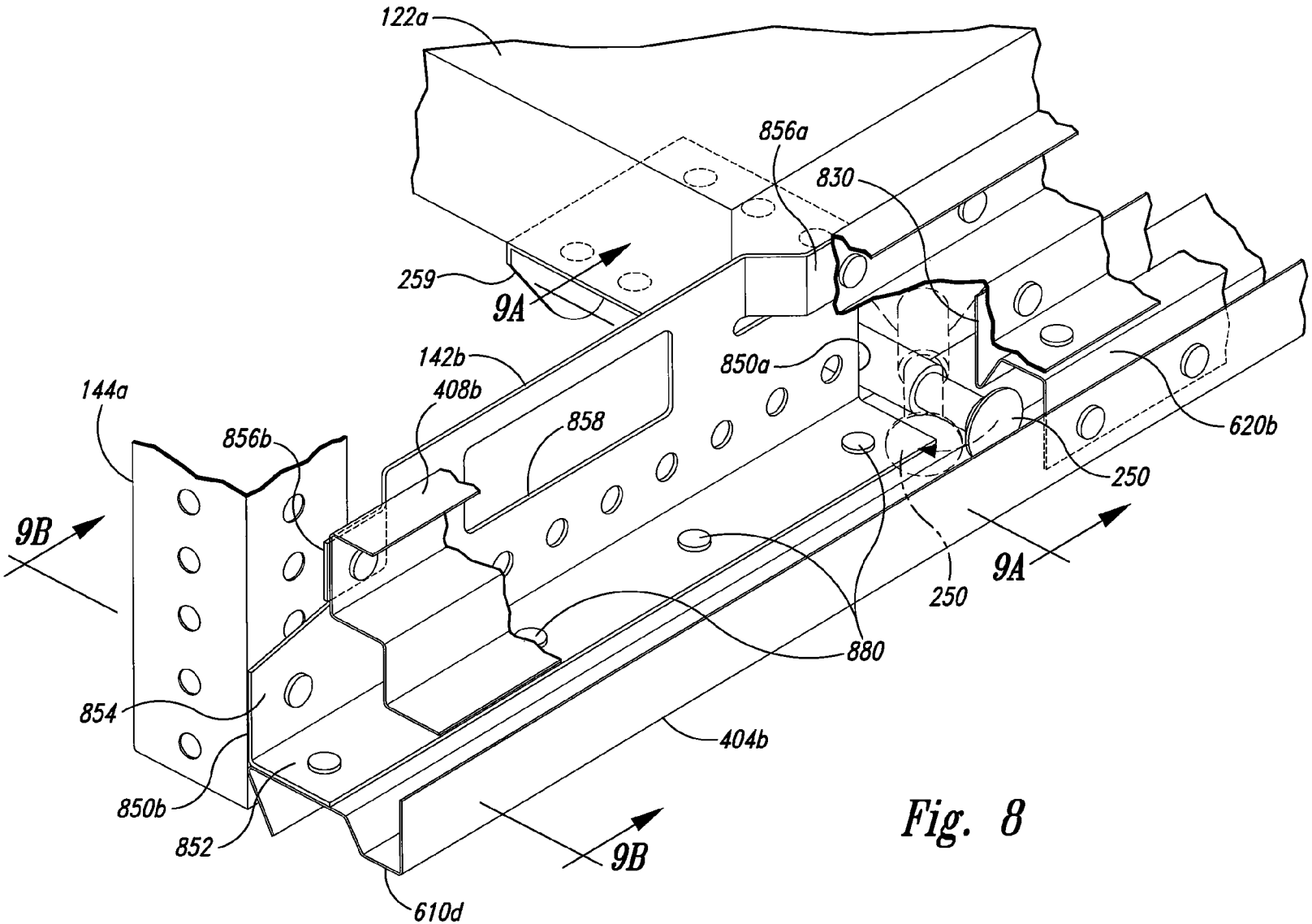
FIG. 8 is an enlarged isometric view of a distal end portion of the door track assembly of FIG. 1, illustrating a track support bracket configured in accordance with an embodiment of the invention.

FIG. 8 is an enlarged isometric view of the distal end portion of the second track assembly 112*b* of FIG. 7, showing various features of the second backhang bracket 142*b* in more detail. In one aspect of this embodiment, the backhang bracket 142*b* includes an upstanding flange 854 extending from a base flange 852. The base flange 852 is fixedly attached to the eighth side portion 610*d* of the non-vertical track segment 404*b* with a plurality of clinched connections or other suitable fasteners 880. The upstanding flange 854 includes a first tab 856*a* positioned toward a leading edge 850*a*, and a second tab 856*b* positioned toward a trailing edge 850*b*. The tabs 856 are fixedly attached to an upper flange portion of the second track brace 408*b*.

In the illustrated embodiment, the upper track rail 620*b* does not extend to the distal end of the non-vertical track segment 404*b*, but instead has an end edge 830 that is positioned just short of the leading edge 850*a* of the backhang bracket 142*b*. Truncating the upper track rail 620*b* at this location enables a technician or other service personnel to remove the interlocking guide member 250 from the non-vertical track segment 404*b* if needed for maintenance, repairs, replacement, etc. This can be accomplished by first detaching the bracket 259 from the door panel 122*a*, rotating the guide member 250 as shown by the dotted lines in FIG. 8, and then extracting the guide member 250 from the non-vertical track segment 404*b*. An access aperture 858 in the backhang bracket 142*b* may provide access to one or more of the fasteners (not shown) that attach the door bumper 145*b* (FIG. 1) to the backhang bracket 142*b*.

Figure 9A:
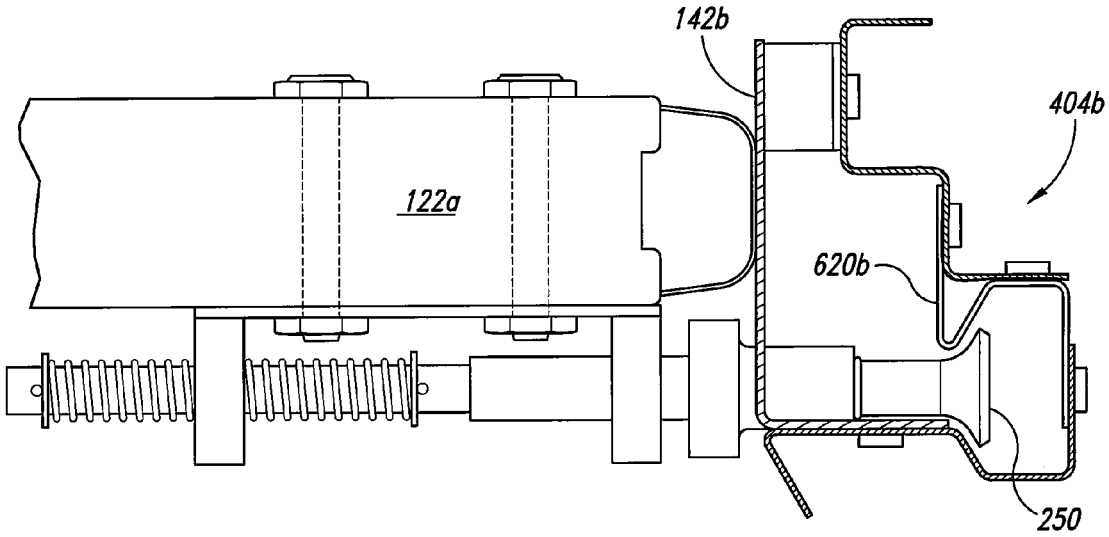
FIGS. 9A and 9B are enlarged, cross-sectional end views of the track section shown in FIG. 8.
Figure 9B:
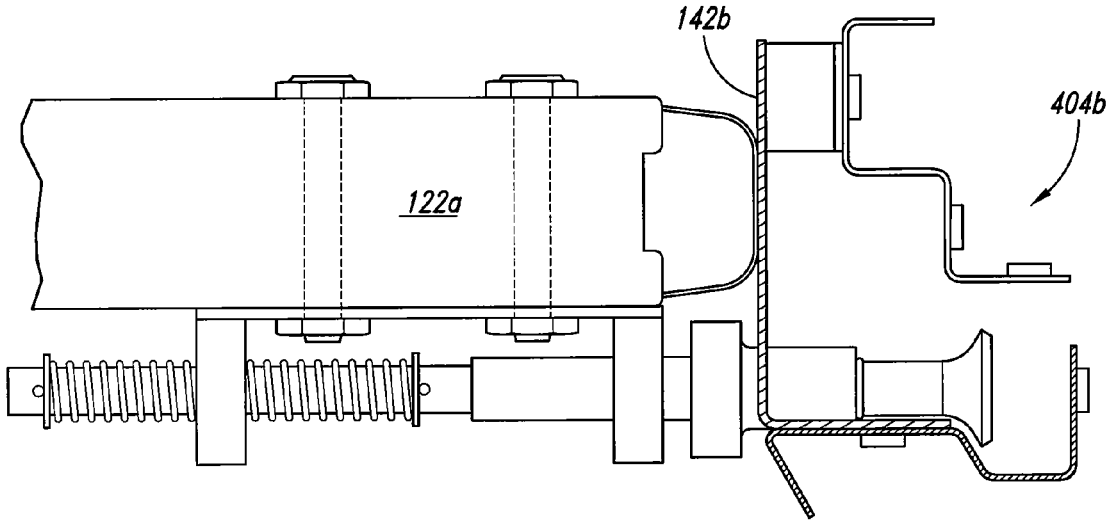

FIGS. 9A and 9B are enlarged, cross-sectional end views taken along lines 9A-9A and 9B-9B in FIG. 8, respectively. These figures illustrate how the backhang bracket 142*b* can function as a secondary door stop system. For example, if one or both of the door bumpers 145 (FIG. 1) fail (or are removed), the door 120 may continue moving aft on the non-vertical track segments 404 when the door 120 is lifted to the overhead position. Eventually, however, the interlocking guide members 250 will run into the leading edges 850*a* (FIG. 8) of the corresponding backhang brackets 142, as shown in FIGS. 9A and 9B. A further feature of the backhang bracket assembly illustrated in FIG. 9B is that the upper track rail 620*b* does not extend to the distal end of the non-vertical track segment 404*b*.

Figure 10A:
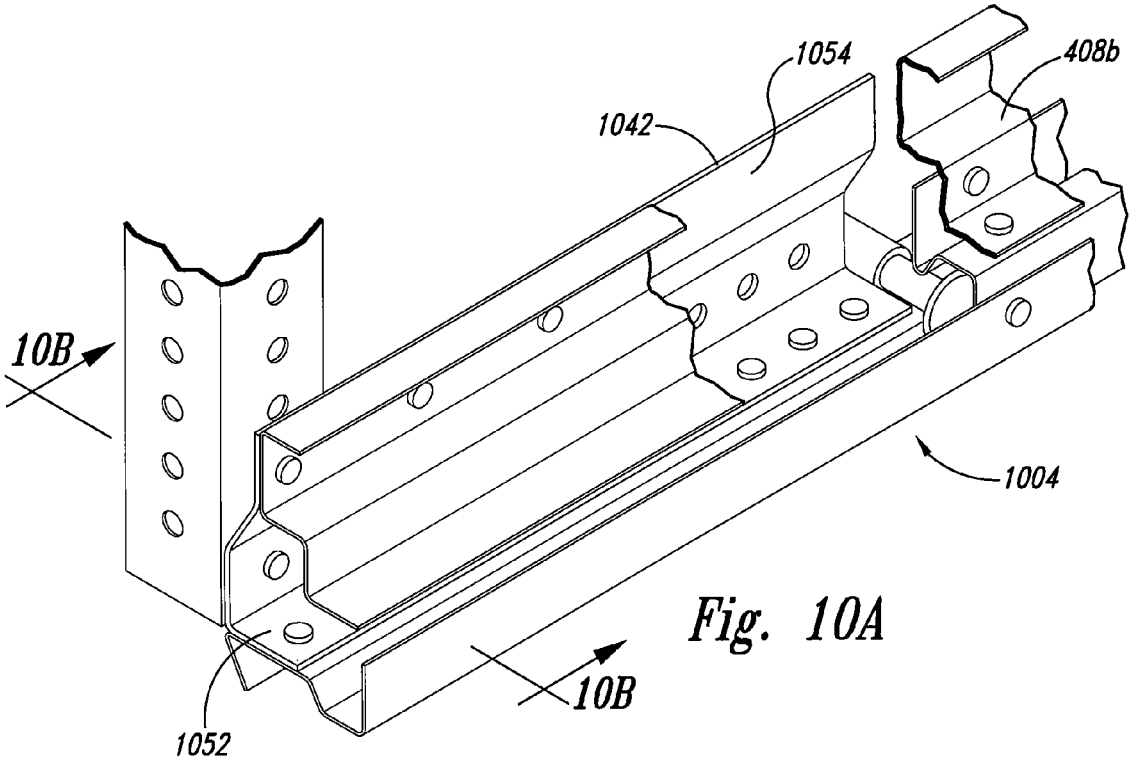
FIG. 10A is an isometric view of a distal end portion of a door track assembly, illustrating a track support bracket configured in accordance with another embodiment of the invention.
Figure 10B:
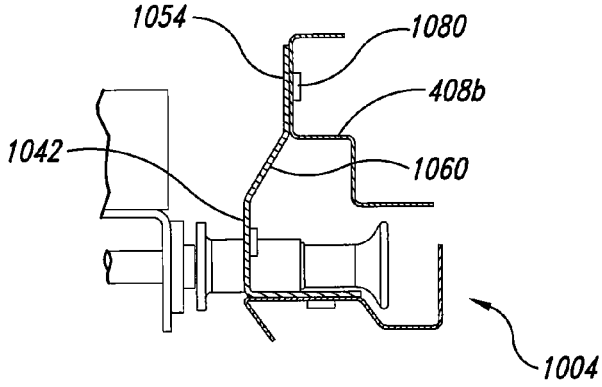
FIG. 10B is an enlarged, cross-sectional end view of the track section shown in FIG. 10A.

FIG. 10A is an enlarged, partially cut-away isometric view of a distal end portion of a non-vertical track segment 1004 having a backhang bracket 1042 configured in accordance with another embodiment of the invention. FIG. 10B is a cross-sectional end view taken along line 10B-10B in FIG. 10A. Referring to FIGS. 10A and 10B together, Many features of the non-vertical track segment 1004 are at least generally similar in structure and function to corresponding features of the non-vertical track segment 404*b* described in detail above with reference to FIGS. 7-9B. For example, the backhang bracket 1042 includes an upstanding flange 1054 that extends from a base flange 1052. In one aspect of this particular embodiment, however, the upstanding flange 1054 includes a joggle 1060 that positions the upstanding flange 1054 in contact with the track brace 408*b* so that the upstanding flange 1054 can be fastened to the track brace 408*b* with a plurality of clinched connections or other suitable fasteners 1080.

Figure 11A:
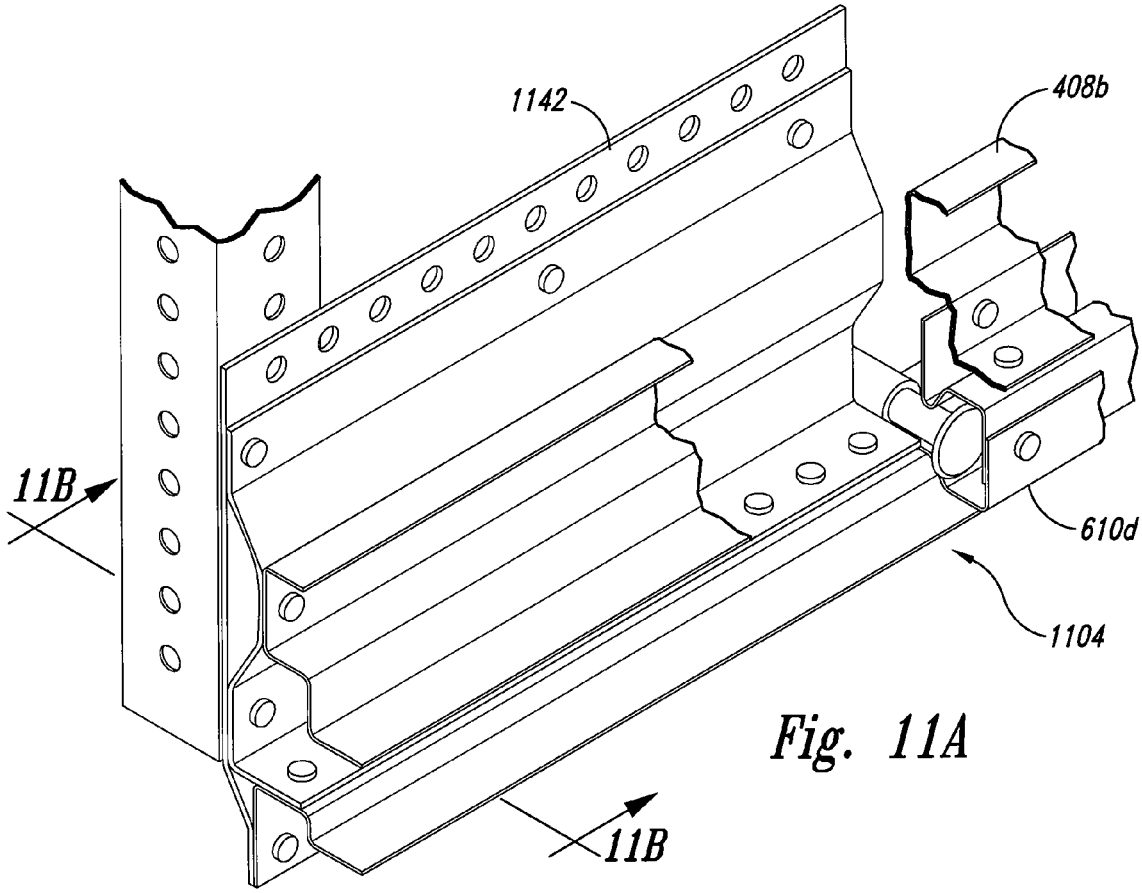
FIG. 11A is an isometric view of a distal end portion of a door track assembly, illustrating a track support bracket configured in accordance with a further embodiment of the invention.
Figure 11B:
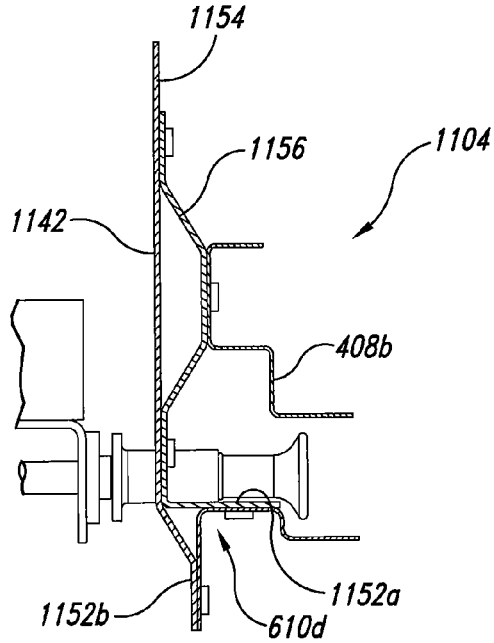
FIG. 11B is an enlarged, cross-sectional end view of the track section shown in FIG. 11A.

FIG. 11A is an enlarged, partially cut-away isometric view of a distal end portion of a non-vertical track segment 1104 configured in accordance with yet another embodiment of the invention, and FIG. 11B is a cross-sectional end view taken along line 11B-11B in FIG. 11A. Referring FIGS. 11A and 11B together, many features of the non-vertical track segment 1104 are at least generally similar in structure and function to the corresponding features of the non-vertical track segments 404 and 1004 described above. For example, the non-vertical track segment 1104 includes a backhang bracket 1142 which is fixedly attached to the track brace 408*b* and the eighth side portion 610*d*. In one aspect of this particular embodiment, however, the backhang bracket 1142 is a subassembly of sheet metal parts having an upstanding flange 1154 with an offset portion 1156, and two base flanges 1152 (identified individually as a first base flange 1152*a* and a second base flange 1152*b*). The two base flanges 1152 provide additional strength and stability to the backhang bracket assembly, while the offset portion 1156 provides an offset surface for fastening the backhang bracket 1142 to the track brace 408*b*.

As FIGS. 8-11B illustrate, there are a number of different backhang bracket configurations consistent with the present disclosure for stabilizing and strengthening non-vertical overhead door track segments, while also acting as secondary door travel stop systems. Accordingly, those of ordinary skill in the art will appreciate that the present invention is not limited to the particular backhang bracket configurations described above, but extends to multiple other configurations embodying the inventive features set forth in the following claims.

From the foregoing, it will be appreciated that specific embodiments of the invention have been described herein for purposes of illustration, but that various modifications may be made without deviating from the spirit and scope of the various embodiments of the invention. Further, while various advantages associated with certain embodiments of the invention have been described above in the context of those embodiments, other embodiments may also exhibit such advantages, and not all embodiments need necessarily exhibit such advantages to fall within the scope of the invention. Accordingly, the invention is not limited, except as by the appended claims.

I claim:

1. A track assembly for use with an overhead door, the track assembly comprising:

a vertical track segment mounted to a wall adjacent an opening therein;

a non-vertical track segment having a proximal end operably coupled to the vertical track segment and a distal end spaced apart from the wall, the non-vertical track segment further including a first side portion spaced apart from a second side portion to define a guide channel therebetween, wherein the guide channel includes a gap region configured to movably receive a shaft portion of at least one door guide member as the door moves away from the opening toward the distal end of the non-vertical track segment, wherein the first side portion of the non-vertical track segment includes a first guide surface and a first retention surface, wherein the second side portion of the non-vertical track segment includes a second guide surface and a second retention surface, wherein the first and second guide surfaces extend away from the gap region toward a first direction, and wherein the first and second retention surfaces diverge from the gap region toward a second direction, opposite to the first direction; and a bracket positioned toward the distal end of the non-vertical track segment, wherein the bracket is offset from the gap region in the first direction, and wherein the bracket extends across the guide channel and is fixedly attached to the first side portion and the second side portion.

2. The track assembly of claim 1 wherein the bracket includes a first flange portion fixedly attached to the first side portion and a second flange portion fixedly attached to the second side portion.

3. The track assembly of claim 1, further comprising a track support member extending between the bracket and an adjacent building structure.

4. The track assembly of claim 1 wherein the track assembly further includes a primary door stop system attached to the non-vertical track segment between the distal end and the wall, and wherein the bracket includes a secondary door stop system positioned to contact the at least one door guide member when the primary door stop system is inoperable.

5. The track assembly of claim 1 wherein the at least one door guide member is a first guide member having a first shaft portion, and wherein the overhead door includes a second guide member having a second shaft portion, wherein the first guide member extends a first distance from a door edge region, and the second guide member extends a second distance from the door edge region, the second distance being less than the first distance:

wherein the gap region is a first gap region having a first width, and wherein the guide channel further includes a second gap region having a second width, the second width being greater than the first width;

wherein the first gap region is configured to movably receive the first shaft portion of the first guide member; and wherein the second gap region is configured to movably receive the second shaft portion of the second guide member.

6. The track assembly of claim 1 wherein the at least one door guide member is a first guide member having a first shaft portion, and wherein the overhead door includes a second guide member having a second shaft portion, wherein the first guide member extends a first distance from a door edge region, and the second guide member extends a second distance from the door edge region, the second distance being less than the first distance:

wherein the gap region is a first gap region having a first width therebetween, wherein the first retention surface is spaced apart from the second retention surface to define the first gap region, wherein the first gap region is configured to movably receive the first shaft portion of the first guide member; and wherein the first guide surface is spaced apart from the second guide surface to define a second gap region having a second width therebetween, wherein the second width is greater than the first width, and wherein the second gap region is configured to movably receive the second shaft portion of the second guide member.

7. The track assembly of claim 6 wherein the first guide surface of the first side portion is at least approximately parallel to the second guide surface of the second side portion.

8. The track assembly of claim 6:

wherein the first guide surface of the first side portion is at least approximately parallel to the second guide surface of the second side portion; and wherein the bracket extends perpendicularly to the first and second guide surfaces.

9. A track assembly for use with an overhead door, the track assembly comprising:

a vertical track segment mounted to a wall adjacent an opening therein;

a curved track segment operably coupled to the vertical track segment, wherein the curved track segment includes:

a first side portion, the first side portion having a first guide surface and a first retention surface;

a second side portion, the second side portion having a second guide surface and a second retention surface, wherein the first guide surface is spaced apart from the second guide surface to define a first gap region therebetween, wherein the first and second guide surfaces extend outwardly from the first gap region toward a first direction, wherein the first and second retention surfaces diverge from the first gap region toward a second direction, opposite to the first direction, and wherein the first gap region movably receives at least one door guide member as the door moves away from the opening; and a non-vertical track segment having a proximal end operably coupled to the curved track segment and a distal end spaced apart from the wall, wherein the non-vertical track segment includes a third guide surface spaced apart from a fourth guide surface to define a second gap region therebetween, wherein the second gap region movably receives the at least one door guide member as the door moves from the curved track segment toward the distal end of the non-vertical track segment, and wherein the first gap region has a first width and the second gap region has a second width, greater than the first width.

10. The track assembly of claim 9 wherein the first and second guide surfaces are at least approximately parallel to each other.

11. The track assembly of claim 9 wherein the first, second, third and fourth guide surfaces are at least approximately parallel to each other.

12. The track assembly of claim 9 wherein the fourth guide surface is at least approximately aligned with the second guide surface where the non-vertical track segment is coupled to the curved track segment.

13. The track assembly of claim 9 wherein the third guide surface is offset from the first guide surface proximate to the proximal end of the non-vertical track segment, and wherein the track assembly further includes a transition surface extending from the first guide surface to the third guide surface.

14. The track assembly of claim 9 wherein the first and second retention surfaces form a V-groove extending inwardly from the first gap region in the second direction.

15. The track assembly of claim 9: wherein the third side portion includes a third retention surface, and the fourth side portion includes a fourth retention surface, wherein the third and fourth guide surfaces extend away from the third and fourth retention surfaces toward the first direction, and wherein the third and fourth retention surfaces extend away from the third and fourth guide surfaces toward the second direction.

16. The track assembly of claim 15:

wherein the fourth guide surface is at least approximately aligned with the second guide surface proximate to the proximal end of the non-vertical track segment;

wherein the first retention surface is at least approximately aligned with the third retention surface proximate to the proximal end of the non-vertical track segment; and wherein the second retention surface is at least approximately aligned with the fourth retention surface proximate to the proximal end of the non-vertical track segment.

17. The track assembly of claim 9 wherein the vertical track segment includes:

a third side portion formed from a first piece of material, the third side portion having a fifth guide surface and a third retention surface;

a fourth side portion formed from a second piece of material, the fourth side portion having a sixth guide surface and a fourth retention surface;

wherein the third side portion is joined to the fourth side portion to define a third gap region therebetween;

wherein the fifth and sixth guide surfaces diverge from the third gap region toward the first direction; and wherein the first and second retention surfaces diverge from the third gap region toward the second direction, opposite to the first direction.

18. An overhead door assembly for use with an opening in a wall, the overhead door assembly comprising:

a track assembly, the track assembly including:

a vertical track segment mounted to the wall adjacent the opening;

a curved track segment operably coupled to the vertical track segment, wherein the curved track segment includes a first guide surface spaced apart from a second guide surface to define a first gap region therebetween, wherein the first and second guide surfaces extend outwardly from the first gap toward a first direction, wherein the first side portion further includes a first retention surface and the second side portion further includes a second retention surface, wherein the first and second retention surfaces extend inwardly from the first gap region toward a second direction, opposite to the first direction; and a non-vertical track segment having a proximal end operably coupled to the curved track segment and a distal end spaced apart from the wall, wherein the non-vertical track segment includes a third guide surface spaced apart from a fourth guide surface to define a second gap region therebetween, wherein the first gap region has a first width and the second gap region has a second width, greater than the first width; and a first door panel having a bottom edge extending between a first side edge and a second side edge;

a first guide assembly attached to the first door panel proximate to the first side edge, wherein the first guide assembly includes a first guide member that movably extends through the first gap region of the curved track segment as the first door panel moves away from the vertical track segment, wherein the first guide member includes a first head portion configured to be movably retained by the first and second retention surfaces;

a second door panel having a top edge extending between a third side edge and a fourth side edge, wherein the top edge of the second door panel is hingeably attached to the bottom edge of the first door panel; and a second guide assembly attached to the second door panel proximate to the third side edge, wherein the second guide assembly includes a second guide member having a second head portion configured to be movably received between the first and second guide surfaces of the curved track segment as the second door panel moves away from the vertical track segment, wherein the second head portion is movably received between the third and fourth guide surfaces of the non-vertical track segment as the second door panel moves away from the curved track segment, and wherein the first head portion of the first guide member is larger than the second head portion of the second guide member.

* * * * *

UNITED STATES PATENT AND TRADEMARK OFFICE

CERTIFICATE OF CORRECTION

PATENT NO. : 7,861,762 B2
APPLICATION NO. : 12/191146
DATED : January 4, 2011
INVENTOR(S) : Michael M. Meichtry It is certified that error appears in the above-identified patent and that said Letters Patent is hereby corrected as shown below:

In column 5, line 55, delete “speed” and insert -- speed. --, therefor.

In column 10, line 63, delete “dimensions” and insert -- dimensions. --, therefor.

In column 15, line 39, in Claim 18, after “gap” insert -- region --.

Signed and Sealed this
Twenty-sixth Day of April, 2011

David J. Kappos

David J. Kappos
*Director of the United States Patent and Trademark Office*